United States Patent [19]

Pioszak

[11] Patent Number: 4,957,450

[45] Date of Patent: Sep. 18, 1990

[54] ELECTRICAL CORD PLUG & SOCKET RETAINER

[76] Inventor: Roger Pioszak, 34306 Joel, New Baltimore, Mich. 48047

[21] Appl. No.: 408,206

[22] Filed: Sep. 18, 1989

[51] Int. Cl.[5] ..... H01R 13/639

[52] U.S. Cl. ..... 439/369; 439/371

[58] Field of Search ..... 439/369-371, 439/502, 449, 451, 894

[56] References Cited

U.S. PATENT DOCUMENTS

| | | | |
|---|---|---|---|
| 2,728,058 | 12/1955 | Phalen | 439/371 |
| 4,440,465 | 4/1984 | Elliott et al. | 439/369 |
| 4,514,026 | 4/1985 | Herbert | 439/297 |
| 4,596,430 | 6/1986 | Olson | 439/369 |
| 4,690,476 | 9/1987 | Morgenrath | 439/369 X |
| 4,702,540 | 10/1987 | Siemon | 439/371 |

*Primary Examiner*—Steven C. Bishop
*Attorney, Agent, or Firm*—Roger A. Marrs

[57] ABSTRACT

A retainer is disclosed herein for releasably securing an electrical power plug and socket together to avoid inadvertant disconnection. The retainer includes an elongated strap attached to the plug and socket respectively with a securement device for releasably attaching the opposite ends of the strap together so that the strap form fits or conforms to the configuration of the plug and socket. The releasable securement device may be of the hook and pile type or a post and eyelet type. Also, the retainer may be integral with either plug or socket member or the strap may be separate with slit passageways for accommodating insertion of the plug and socket cords during assembly of the strap with the power cords.

1 Claim, 1 Drawing Sheet

ELECTRICAL CORD PLUG & SOCKET RETAINER

BACKGROUND OF THE INVENTION

1. Field of the Invention

The present invention relates to the field of electrical couplers and strain relief devices, and more particularly to a novel retainer for releasably holding electrical power cord plug and sockets in connected positions.

2. Brief Description of the Prior Art

In the past, it has been the conventional practice to join the plug of an electrical power cord, such as from a hand power tool, with a socket carried on the end of an extension cord. During the manipulation of the power tool by the user, substantial stress is placed on the power cord which generally works the interconnection between the plug and socket free so that a mechanical and electrical disconnect occurs. The user must then stop his work and reconnect the power cord plug with the extension cord socket so that work can continue.

Some attempts have been made to avoid such inadvertant disconnection by looping or coiling the power cord and extension cord in such a manner that the loop provides a stress relief to absorb any disconnecting loads before they are applied to the connected plug and socket. Although this may work for a while, such a practice places unnecessary strain on the wires of the cord itself which causes fraying and eventual separation of the insulation from the plug or socket itself where the cord connects therewith. In other instances, heavy metal plates and other solid retainers are used for holding the socket and plug in place. Such a device is not flexible and does not permit the user to move about with the power tool since the retaining plate is heavy and is sometimes affixed to solid support structure.

Therefore, a long standing need has existed to provide a simple and inexpensive retainer that may be assembled by the user at a worksite about the power cord plug and extension cord socket so that the two electrical connector components are held in a mechanical and electrical connection so as to prevent inadvertant disconnection or disassembly.

SUMMARY OF THE INVENTION

Accordingly, the above problems and difficulties are obviated by the present invention which provides a novel retainer for releasably securing an electrical cord plug and socket connection in its connected position. The retainer includes an elongated strap having opposite ends which are releasably secured together when the strap is wrapped or trained about the electrical components desired to be held together. The strap includes passageway means for insertably receiving an electrical component and to permit passage of the cord therethrough as the strap is wrapped or trained about the electrical component. Securement means taking the form of a hook and pile fastener or a post and eyelet fastener is used to interconnect the ends of the strap together for releasable securement of the plug and socket connector components.

Preferably, the strap is composed of a non-stretch material and the releasable securement means is positive so that sheer loads placed on the retainer due to strain on the cords will not cause a loosening of the electrical and mechanical connection between the plug and socket component.

Therefore, it is among the primary objects of the present invention to provide a novel retainer for releasably securing an electrical plug and socket arrangement in a positive electrical and mechanical connection so that the connection will not be disrupted or disconnected due to inadvertant sheer loads or stress loads placed on the electrical cords.

Another object of the present invention is to provide a simple and inexpensive retaining device for releasably securing power cord plug and sockets together in a connected relationship that is easy to install and may be readily manipulated between its secured and unsecured position by the user.

Still another object of the present invention is to provide a lightweight and flexible retainer for securing an electrical power cord plug and extension cord socket together in connected relationship that may be either integral with the plug and socket components or may be a separate piece attachable by the user at the worksite.

A further object of the present invention is to provide a novel retainer for releasably securing a connected plug and socket together which employs a hook and pile fastener so that alignment of fastening elements is not required.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
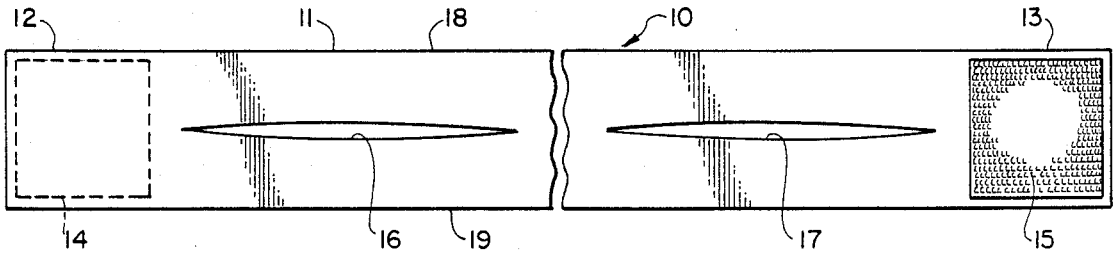
FIG. 1 is a top plan view of the novel retainer incorporating the inventive concept.

Referring to FIG. 1, one form of retainer for releasably securing an electrical power cord plug and socket together is illustrated in the general direction of arrow 10 which includes an elongated strap 11 having opposite ends 12 and 13 to which the components of a hook and pile fastener are carried. The hook and pile fastener is employed for releasably securing the opposite ends of the strap together when the strap retainer is assembled with a plug and socket connected. On strap 11, a hook pad 14 is secured to end 12 while a pile pad 15 is secured on the opposite end and side of the strap 11 on end 13. The width of the strap 11 is substantially similar to the width of a conventional plug or socket and slits 16 and 17 are provided along the center line of the elongated strap 11 midway between the side edge marginal regions 18 and 19. The slots 16 and 17 provide passageways through which the respective plug and sockets are inserted during assembly of the retainer onto the power cord and extension cord.

Figure 2:
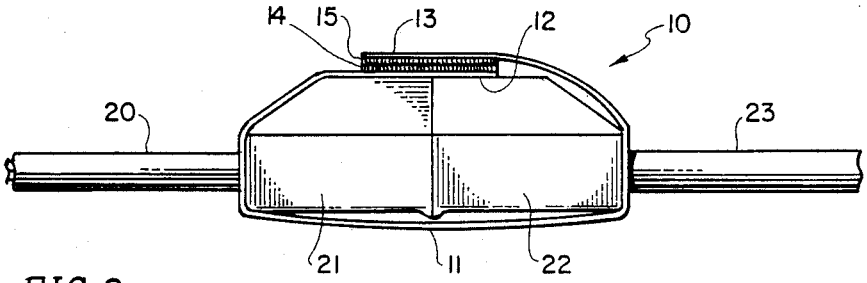
FIG. 2 is a side elevational view of the retainer shown in FIG. 1 assembled onto a power cord plug and a connected extension cord socket.

Referring to FIG. 2 in detail, it can be seen that a power cord 20 is provided with a plug 21 at one end which is in electrical and mechanical connection with a socket 22 carried on the end of an extension cord 23. The retainer 10 incorporating the present invention is installed or assembled onto the cords 20 and 23 by inserting the respective plug 21 and socket 22 through the slots 16 and 17 followed by folding the ends 12 and 13 over the plug and sockets for attachment by the hook and pile fastener. In so doing, the strap 11 is conformal to the exterior shape or configuration of the plug and socket respectively. Should any stress or sheer load be applied to the cords 20 or 23, the retainer 10 would resist separation of the plug from the socket. By employing a hook and pile fastener, the opposite ends 12 and 13 of strap 11 need not be placed in registration or alignment so that the strap fits about the respective plug and socket components in a tight manner.

Figure 3:
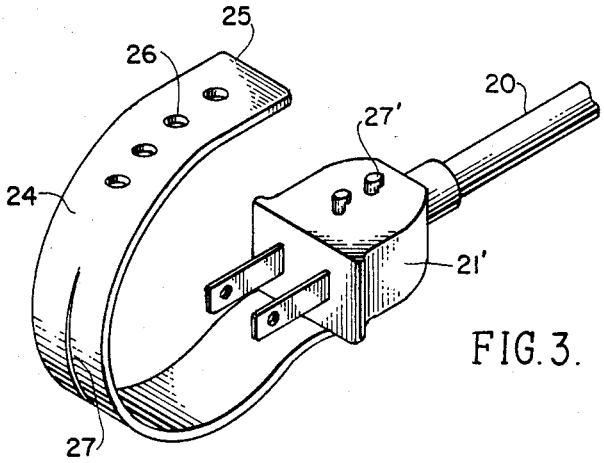
FIG. 3 is a front perspective view of another embodiment of retainer incorporating the present invention which is integral to the plug component of the plug and socket combination.
Figure 4:
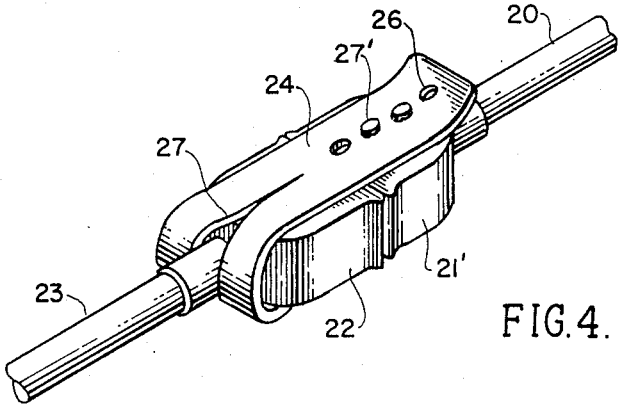
FIG. 4 is a view similar to the view of FIG. 3 illustrating the secured interconnection between the plug and socket and held together by the retainer shown in FIG. 3.

Referring now in detail to FIGS. 3 and 4, another embodiment of the invention is illustrated wherein a strap 24 is integrally formed with a plug 21 so that when the connector socket 22 is engaged with the plug 21 the strap may be wrapped about the socket 22 so that its end 25 may be secured to the plug 21. Securement is achieved by aligning a selected one of holes, such as hole 26, with posts or pins 27 carried on the plug 21. When registry is achieved, the posts or pins are snaplocked into at least a pair of the aligned holes 26. A slot 27 is provided so that the cord 23 as well as the socket 22 may be passed therethrough in order to effect alignment of the pins with the holes for securement. It is to be particularly noted that the embodiment shown in FIGS. 3 and 4 is considered an integral construction of the strap whereby one end of the strap is integral with the body of the plug 21. It is also to be envisioned that the strap may be integral with the socket rather than the plug. The advantage of making the strap integral resides in the fact that the strap is not separate from the plug and therefore cannot be lost or misplaced. The strap 11 used in the configuration of FIG. 2 may be held onto the power cord or extension cord by any suitable holder such as is commonly used in holding drill bits and drill keys or the like.

In view of the foregoing, it can be seen that the retainer of the present invention will maintain a good electrical and mechanical connection between the electrical components of the plug and socket when the two are joined together. Any strain or load which is applied along the longitudinal access of the components is resisted by the strap since the strap is trained or directed around the opposite or rear end of each of the plug and socket components. Therefore, the plug and socket combination as assembled is held in position and any effort to separate the components is resisted by the strap retainer. The retainer is flexible so that it will readily be positionable about the end of the respective components and so that it may be drawn into a tight condition when secured. The strap is simple to manufacture and is inexpensive.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A retainer for releasably securing a combined plug and socket in connection in an unsupported position comprising:

an elongated flexible member having opposite ends separated by a midsection;

at least one slot provided in said elongated flexible member between said opposite ends and disposed midway between opposite edges defining the sides of said member;

said slot lying along the central longitudinal axis of said elongated member;

securement means cooperatively carried on said elongated flexible member for releasably joining said opposite ends together;

said flexible member is a strap and at least two slots are provided in spaced-apart relationship for receiving passage of the plug and socket respectively whereby said strap encircles the plug and socket connection to retain and restrain separation of the plug and socket; and said securement means is a hook and pile fastener having a hook portion secured to one of said opposite ends and a pile portion carried on the other of said opposite ends.

* * * * *